US008517506B2

(12) United States Patent
Kawakami

(10) Patent No.: US 8,517,506 B2
(45) Date of Patent: Aug. 27, 2013

(54) FLUID EJECTING APPARATUS

(75) Inventor: Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 328 days.

(21) Appl. No.: 13/022,509

(22) Filed: Feb. 7, 2011

(65) Prior Publication Data

US 2011/0193906 A1 Aug. 11, 2011

(30) Foreign Application Priority Data

Feb. 8, 2010 (JP) ..... 2010-025946

(51) Int. Cl.
*B41J 2/165* (2006.01)

(52) U.S. Cl.
USPC ..... 347/31

(58) Field of Classification Search
CPC ..... B41J 2/16585; B41J 2002/1742
USPC ..... 347/9, 14, 31, 35
See application file for complete search history.

(56) References Cited

U.S. PATENT DOCUMENTS 7,562,961 B2 7/2009 Inoue
2010/0118084 A1 5/2010 Seshimo

FOREIGN PATENT DOCUMENTS

JP 2005-119284 5/2005

*Primary Examiner* — An Do
(74) *Attorney, Agent, or Firm* — Workman Nydegger

(57) ABSTRACT

A fluid ejecting apparatus includes a fluid ejecting head having nozzle rows formed by a plurality of nozzles, in which a fluid is ejected from the nozzle rows. The fluid ejecting apparatus includes a linear absorbing member which extends along the nozzle row, is installed so as to move from one side of the nozzle row to the other side, and absorbs the fluid ejected from the nozzles, the linear shaped absorbing member absorbing the fluid ejected from the nozzles, a running mechanism which runs the absorbing member from the one side of the nozzle row to the other side, a detection mechanism which detects a running speed of the absorbing member run by the running mechanism, and an adjustment unit which adjusts the running speed of the absorbing member run by the running mechanism based on the running speed of the absorbing member detected by the detection mechanism.

7 Claims, 12 Drawing Sheets

FLUID EJECTING APPARATUS

This application claims a priority to Japanese Patent Application No. 2010-025946 filed on Feb. 8, 2010 which is hereby expressly incorporated by reference herein in its entirety.

BACKGROUND

1. Technical Field

The present invention relates to a fluid ejecting apparatus.

2. Related Art

In the related art, an ink jet printer (hereinafter refer to as a "printer") is widely known as a fluid ejecting apparatus capable of ejecting ink droplets onto a printing sheet (medium). Such a printer has a problem that nozzles are clogged by increased viscosity or solidification of ink which results from evaporation of the ink from the nozzles of a printing head, attached dust, comingling of bubbles, or the like, thereby resulting in printing failure. Accordingly, such a printer is configured to carry out a flushing operation to forcibly discharge the ink from the inside of the nozzles, aside from the ejection with respect to the printing sheets.

In general, although a printing head is moved to an area other than a printing area to carry out the flushing operation in a scan type printer, the printer equipped with a line head with the fixed printing head is not able to move the printing head at the time of the flushing operation. Accordingly, for example, a method of ejecting the ink into an absorbing material (absorbing member), which is provided on a surface of a transporting belt for transporting the printing sheet, has been considered (refer to JP-A-2005-119284).

However, in the technology disclosed in JP-A-2005-119284, since a plurality of absorbing materials are placed at regular intervals on the transporting belt to coincide with the size of the printing sheet, the ink should be ejected while aiming for a gap between the printing sheets at flushing. Therefore, there is a problem that the size of the printing sheets or the transporting speed of the printing sheet is limited. In addition, if the flushing is carried out with respect to the planar absorbing material, the ink of a mist form is scattered by wind pressure which is generated by the discharge of the ink droplets, so that the surface of the printing sheet or the transporting belt may be contaminated.

Accordingly, there is considered a method of receiving the ink into an absorbing member, in which a linear absorbing material is used, and the linear absorbing member (absorbing material) is interposed between the line head and the printing sheet (printing medium), so that the flushing is carried out by ejecting the ink to the absorbing member. In this instance, since the quantity of the ink received by the absorbing member is limited, if the ink is absorbed to some extent, the absorbing member is moved, and then the flushing is carried out into the new area of the absorbing member to again store the ink.

However, in the case where the absorbing member is moved, if its running speed (moving speed) is not stable, the area receiving the ink comes in contact with the head or the printing sheet, which will make it dirty. In addition, as the area receiving the ink remains at the position to receive the ejection of the ink, the quantity of the ink received into the area may exceed the limit. Further, as the absorbing member is excessively moved beyond a predetermined distance, the efficient use of the absorbing member can be deteriorated.

SUMMARY

An advantage of some aspects of the invention is that it is to provide a fluid ejecting apparatus including a linear absorbing member for receiving a fluid, in which when the absorbing member is moved, its running speed (moving speed) can be stabilized to prevent contamination of a head or printing medium (printing sheet) and deterioration of efficient use of the absorbing member.

According to an aspect of the invention, there is provided a fluid ejecting apparatus including a fluid ejecting head having nozzle rows formed by a plurality of nozzles, in which a fluid is ejected from the nozzle rows, the fluid ejecting apparatus including: a linear absorbing member which extends along the nozzle row, is installed so as to move from one side of the nozzle row to the other side, and absorbs the fluid ejected from the nozzles; a running mechanism which runs the absorbing member from the one side of the nozzle row to the other side; a detection mechanism which detects a running speed of the absorbing member run by the running mechanism; and an adjustment unit which adjusts the running speed of the absorbing member run by the running mechanism based on the running speed of the absorbing member detected by the detection mechanism.

According to an aspect of the fluid ejecting mechanism, since the running speed of the absorbing member run by the running mechanism is detected by the detection mechanism, and the running speed of the absorbing member run by the running mechanism is adjusted by the adjustment unit based on the running speed of the detected absorbing member, if the running speed of the absorbing member is different from a prescribed running speed set in advance, the running speed of the absorbing member is adjusted to the set running speed by the adjustment unit, so that the running speed of the absorbing member is able to stabilize. Accordingly, it prevents a problem, for example, that the running speed of the absorbing member gets slow, and tension is decreased lower than a set value and thus the absorbing member sags downward to come into contact with the printing medium, which causes the printing medium to be contaminated. In addition, as the running speed of the absorbing member is stabilized, the absorbing member can be accurately moved while a relative position of the absorbing member with respect to the fluid ejecting head is maintained at a set state. Consequently, it is also possible to prevent another problem that the absorbing member is moved beyond a predetermined distance to deteriorate the efficient use of the absorbing member.

In the fluid ejecting apparatus, it is preferable that the detection mechanism includes a simultaneous ejection control unit which controls the nozzle row to simultaneously eject the fluid to the running absorbing member from other predetermined nozzles, a position sensing unit which senses each receiving position of the running absorbing member which receives the fluid ejected from the other nozzles, and a detection unit which detects the running speed of the absorbing member based on a time when each of the receiving positions is sensed by the position sensing unit.

With the above configuration, since each of the receiving positions of the fluid is sensed by the position sensing unit in the absorbing member running while receiving the fluid ejected from the other nozzles, the time detecting each receiving position is obtained. Consequently, a time elapsed from detection of the former receiving position to the later receiving position is obtained. Since the length (distance) between these receiving positions corresponds (coincide) to the length (distance) between the other predetermined nozzles, the length is divided by the time elapsed, and thus the running speed of the absorbing member is obtained by the detection unit.

In addition, in the fluid ejecting apparatus, it is preferable that the absorbing member to which is attached an indicator of a predetermined length, and the detection mechanism includes a position sensing unit which senses the indicators attached to other positions of the running absorbing member, and a detection unit which detects the running speed of the absorbing member based on a time when the indicators are respectively sensed by the position sensing unit.

With the above configuration, since the indicators attached to other positions of the running absorbing member are respectively detected, the time to detect each of the indicators is obtained. Accordingly, the time elapsed from the detection of the former indicator to the detection of the later indicator is obtained. Since the length (distance) between these indicators is set to a prescribed predetermined length, the length is divided by the time elapsed, and thus the running speed of the absorbing member is obtained by the detection unit.

Further, in the fluid ejecting apparatus, it is preferable that the detection mechanism includes an ejection control unit which controls the nozzle row to eject the fluid to the running absorbing member at a predetermined time interval from nozzles of predetermined positions, a length sensing unit which recognizes receiving positions of the fluid ejected from the nozzles of the predetermined positions in the running absorbing member to detect the length between the receiving positions, and a detection unit which detects the running speed of the absorbing member based on the length between the receiving positions sensed by the length sensing unit.

With the above configuration, since the receiving positions of the fluid of the absorbing member receiving and running the fluid ejected at the predetermined time interval are sensed by the length sensing unit to detect the length between the receiving positions, the length is divided by the predetermined time, so that the running speed of the absorbing member is obtained by the detection unit.

In addition, in the fluid ejecting apparatus, it is preferable that the absorbing member extends along the nozzle row, and is configured to move relatively between a position, in which the fluid ejected from the nozzles is absorbed, and a position retracted from a flying path of the fluid ejected from the nozzles.

In this way, since the absorbing member is formed in the linear shape, the absorbing member can be moved to a position retractable from the flying path by a slight movement. Consequently, it is possible to shorten the time necessary for the maintenance associated with the flushing.

Further, in the fluid ejecting apparatus, it is preferable that the running mechanism includes a rotation body which is able to wind the absorbing member thereon.

In this way, it is possible to easily adjust the running speed of the absorbing member by adjusting a rotation speed of the rotation body.

BRIEF DESCRIPTION OF THE DRAWINGS

The invention will be described with reference to the accompanying drawings, wherein like numbers reference like elements.

DESCRIPTION OF EXEMPLARY EMBODIMENTS

A fluid ejecting apparatus according to a first embodiment of the invention will now be described with reference to the accompanying drawings. In this instance, in the various drawings used in the following description, the scales of the various constituents are appropriately modified in order to allow the respective constituents to have various sizes.

In this embodiment, an ink jet printer (hereinafter, simply referred to as a printer) is exemplified as the fluid ejecting apparatus.

Figure 1:
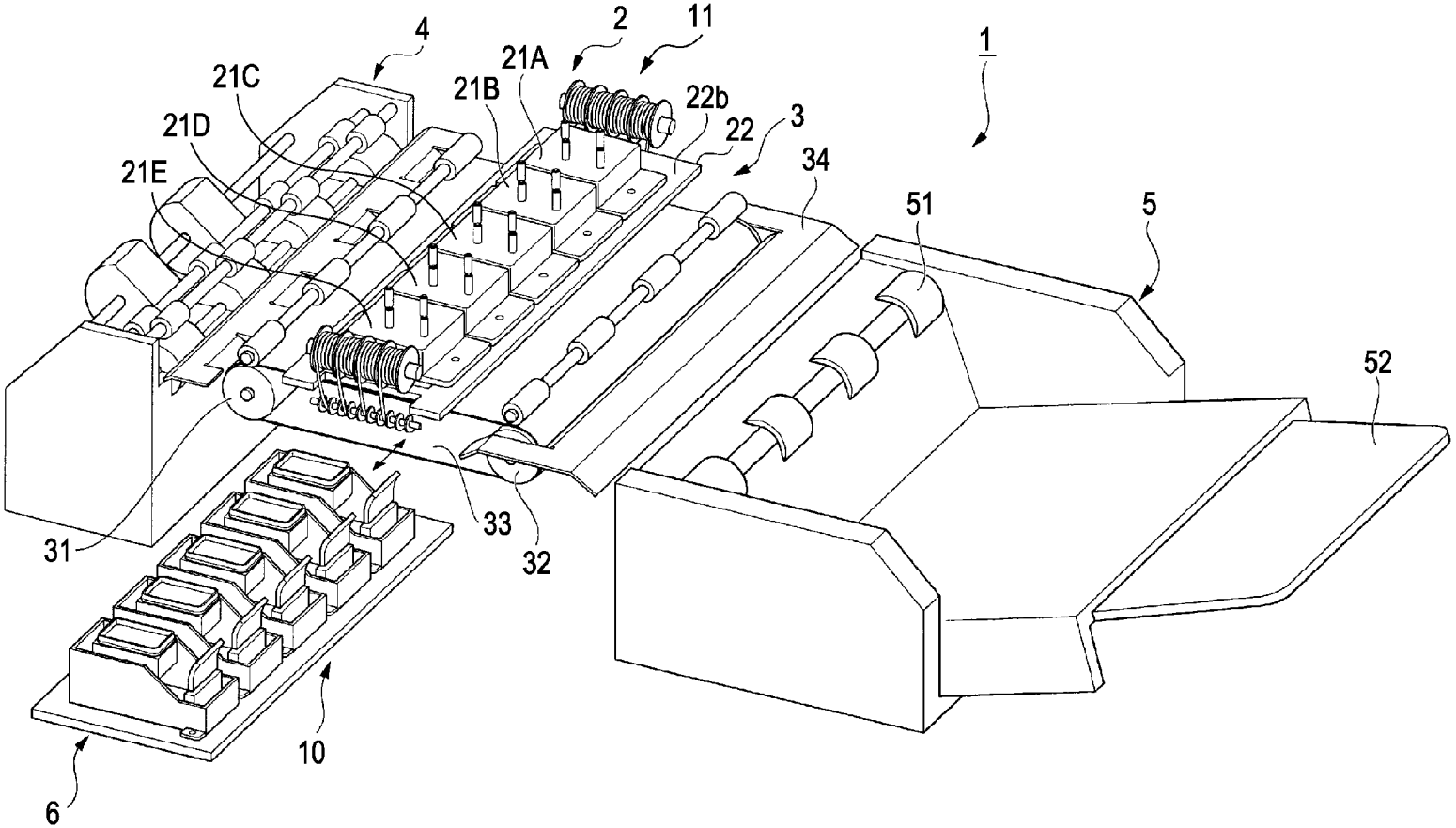
FIG. 1 is a perspective view schematically illustrating the configuration of a printer according to a first embodiment.
Figure 2:
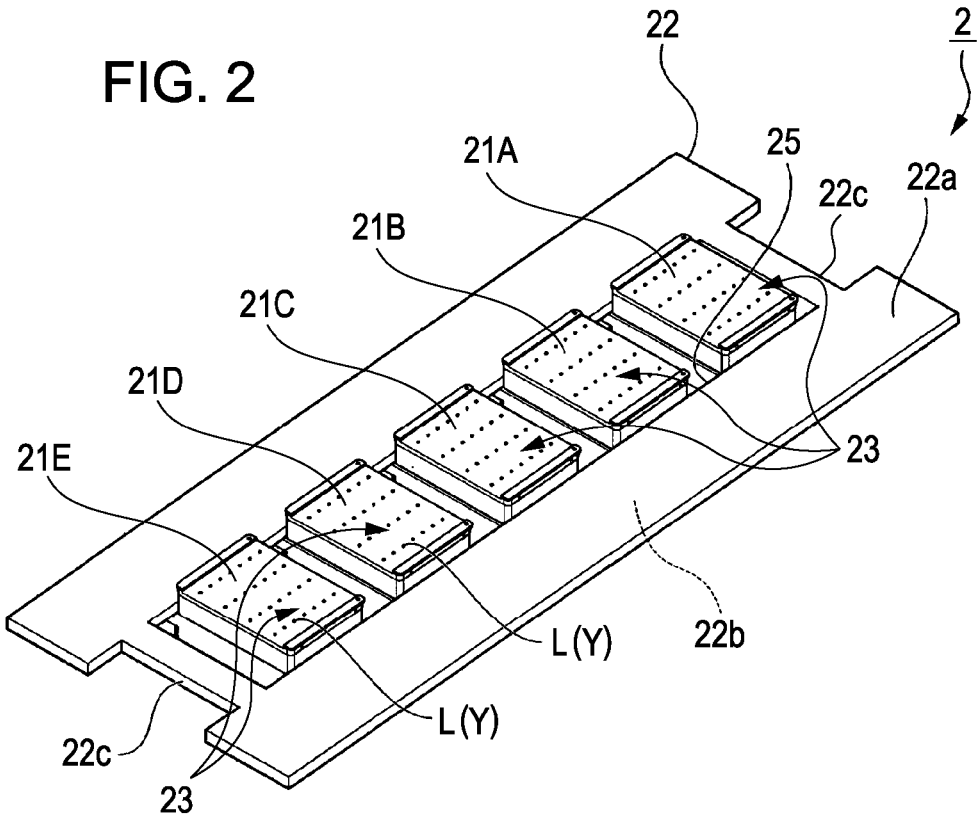
FIG. 2 is a perspective view schematically illustrating the configuration of a head unit according to a first embodiment.
Figure 3:
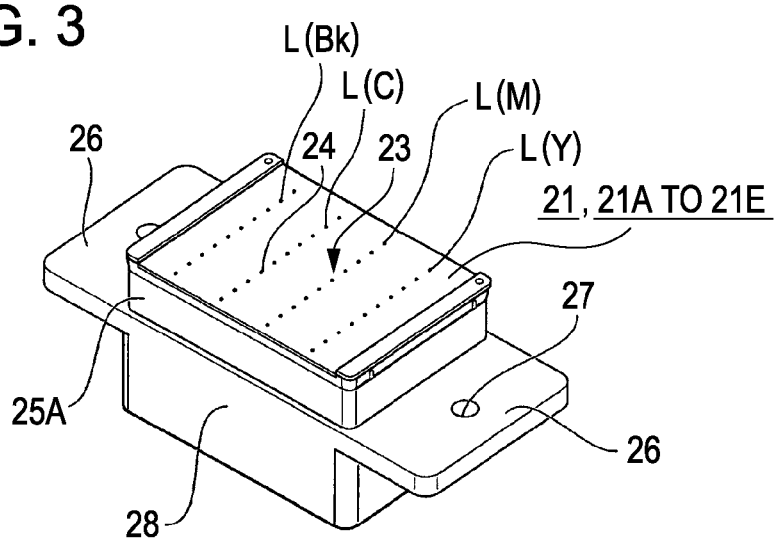
FIG. 3 is a perspective view schematically illustrating the configuration of a printing head according to a first embodiment.
Figure 4:
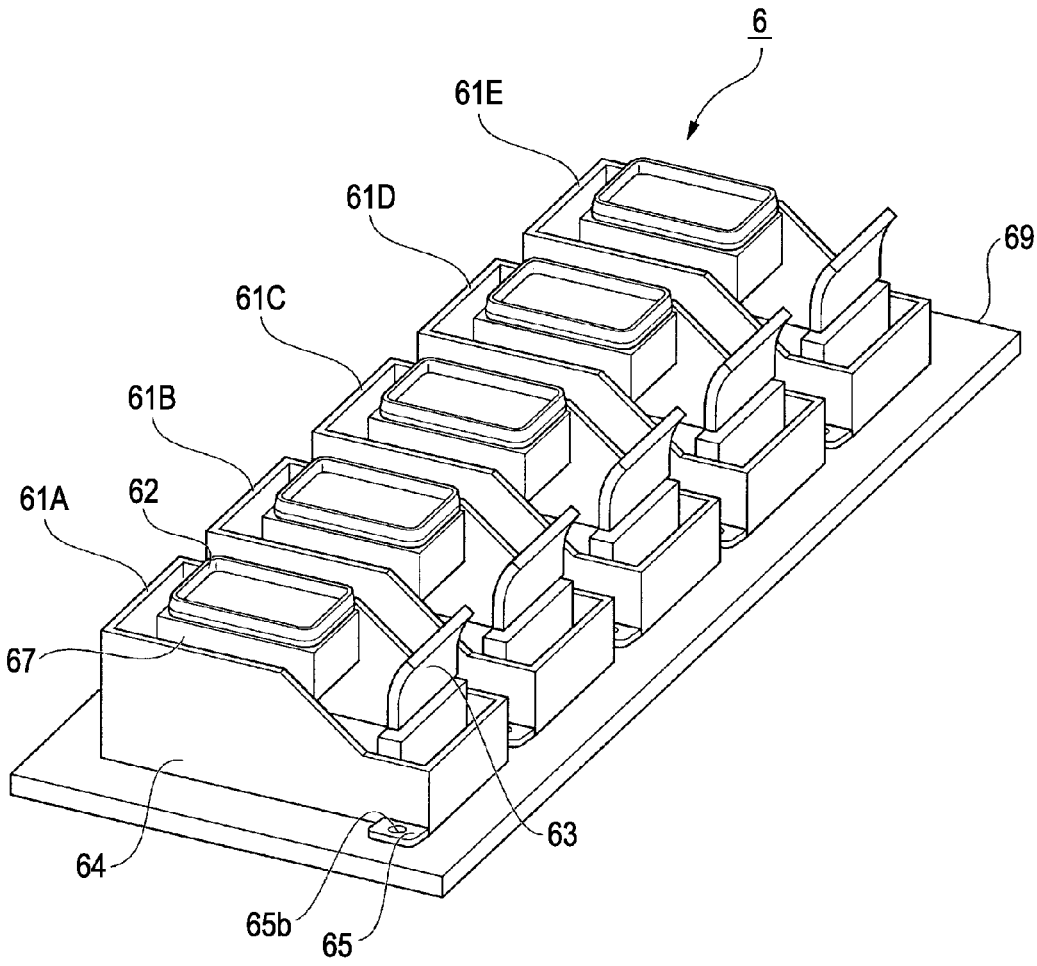
FIG. 4 is a perspective view schematically illustrating the configuration of a cam unit according to a first embodiment.

FIG. 1 is a perspective view schematically illustrating the configuration of the printer. FIG. 2 is a perspective view schematically illustrating the configuration of a head unit. FIG. 3 is a perspective view schematically illustrating the configuration of a printing head (fluid ejecting head) constituting the head unit. FIG. 4 is a perspective view schematically illustrating the configuration of a cap unit.

As shown in FIG. 1, a printer 1 includes a head unit 2, a transporting device 3 which transports a printing sheet (printing medium), a sheet feeding unit 4 which supplies the printing sheet, a sheet discharging unit 5 which discharges the printing sheet subjected to a printing operation of the head unit 2, and a maintenance device 10 which performs a maintenance operation on the head unit 2.

The transporting device 3 is adapted to hold the printing sheet while maintaining a predetermined gap between the printing sheet and nozzle surfaces 23 of printing heads 21 (21A, 21B, 21C, 21D, and 21E) constituting the head unit 2. The transporting device 3 includes a driving roller portion 31, a driven roller portion 32, and a transporting belt portion 33 which has plural belts suspended between the roller portions 31 and 32. In addition, a holding member 34 is provided between the sheet discharging units 5 which is the downstream portion of the transporting device 3 (on the side of the sheet discharging unit 5) in the transporting direction of the printing sheet so as to hold the printing sheet.

One end of the driving roller portion 31 in the rotation direction is connected to a driving motor (not illustrated), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

The head unit 2 is formed as a unit including plural (in this embodiment, five) printing heads 21A to 21E, and plural colors of ink (for example, ink having colors of black B, magenta M, yellow Y, and cyan C) adapted to be ejected from nozzles 24 (refer to FIG. 3) of the printing heads 21A to 21E. The printing heads 21A to 21E (hereinafter, referred to as the printing heads 21 in some cases) are formed as a unit which is attached to an attachment plate 22. That is, the head unit 2 according to this embodiment constitutes a line head module which has plural combinations of printing heads 21 and in which an effective printing width of the head unit 2 is substantially equal to the transverse width (the width perpendicular to the transporting direction of the printing sheet) of the printing sheet. In addition, the printing heads 21A to 21E have the same structure.

As shown in FIG. 2, the head unit 2 has a configuration in which the printing heads 21A to 21E are arranged inside an opening 25 formed in an attachment plate 22. More specifically, the printing heads 21A to 21E are screw-fixed to a rear surface 22*b* side of the attachment plate 22 so that the nozzle surfaces 23 project toward a front surface 22*a* of the attachment plate 22 through the opening 25. In addition, the head unit 2 is mounted onto the printer 1 by fixing the attachment plate 22 to a carriage (not illustrated).

The head unit 2 according to this embodiment is adapted to be movable between a printing position and a maintenance position (in a direction depicted by the arrow in FIG. 1) by the carriage. Here, the printing position is a position which faces the transporting device 3 and in which a printing operation is performed on the printing sheet. Meanwhile, the maintenance position is a position in which the head unit 2 is retracted to the transporting device 3 and which faces a maintenance device 10. In the maintenance position, a maintenance operation (a suction operation and a wiping operation) is performed on the head unit 2.

As shown in FIG. 3, each of the printing heads 21A to 21E (hereinafter, simply referred to as the printing head 21 in some cases) constituting the head unit 2 includes a head body 25A which has the nozzle surface 23 having nozzle rows L formed by plural nozzles 24 and a support member 28 onto which the head body 25A is mounted.

Each of the printing heads 21A to 21E has four nozzle rows L (L(Y), L(M), L(C), and L(Bk)) corresponding to four colors (yellow (Y), magenta (M), cyan (C), and black (Bk)). In the nozzle rows (L(Y), L(M), L(C), and L(Bk)), the nozzles 24 constituting the nozzle rows (L(Y), L(M), L(C), and L(Bk)) are arranged in the horizontal direction perpendicular to the transporting direction of the printing sheet, and more specifically, are arranged in the horizontal direction perpendicular to the transporting direction of the printing sheet. In addition, in the direction where the printing heads 21A to 21E are arranged, the nozzle rows L of the printing heads 21A to 21E having the same color are aligned in a line.

Projecting portions 26 and 26 are formed on both sides of the support member 28 in the longitudinal direction of the nozzle surface 23. In addition, each of the projecting portions 26 and 26 is provided with a penetration hole 27 which is used to screw-fix the printing head 21 to the rear surface 22*b* of the attachment plate 22. Accordingly, the head unit 2 is obtained in which the plural printing heads 21 are attached to the attachment plate 22 (see FIG. 1).

The maintenance device 10 includes a cap unit 6 which receiving the ink ejected by the flushing operation performs the suction operation on the head unit 2 and a flushing unit 11 on the head unit 2.

As shown in FIG. 4, the cap unit 6 is a unit which performs the maintenance operation on the head unit 2 and includes plural (in this embodiment, five) cap portions 61A to 61E respectively corresponding to the printing heads 21A to 21E. The cap unit 6 is disposed at a position deviated from the printing area of the head unit 2.

The cap portions 61A to 61E (hereinafter, simply referred to as a cap portion 61 in some cases) respectively correspond to the printing heads 21A to 21E, and are adapted to respectively come into contact with the nozzle surfaces 23 of the printing heads 21A to 21E. Since the cap portions 61A to 61E respectively come into close contact with the nozzle surfaces 23 of the printing heads 21A to 21E with the above configuration, it is possible to satisfactorily perform the suction operation in which ink (fluid) is discharged from the nozzle 35 of each of the nozzle surfaces 23.

In addition, each of the cap portions 61A to 61E includes a cap body 67, a seal member 62 which is formed on the upper surface of the cap body 67 so as to have a frame shape and comes into contact with the printing head 21, a wiper member 63 which is used in the wiping operation of wiping the nozzle surface 23 of the printing head 21, and a casing portion 64 which integrally retains the cap body 67 and the wiper member 63.

The bottom portion of the casing portion 64 is provided with two holding portions 65 (here, one of them is not shown in the drawing) which are used to hold the casing portion 64 in a base member 69. The holding portions 65 are disposed in the casing portion 64 so as to have a diagonal relationship therebetween at a plan view. Each of the holding portions 65 is provided with a penetration hole 65*b* into which a screw is inserted so as to screw-fix the casing portion 64 to the base member 69.

Figure 5A:
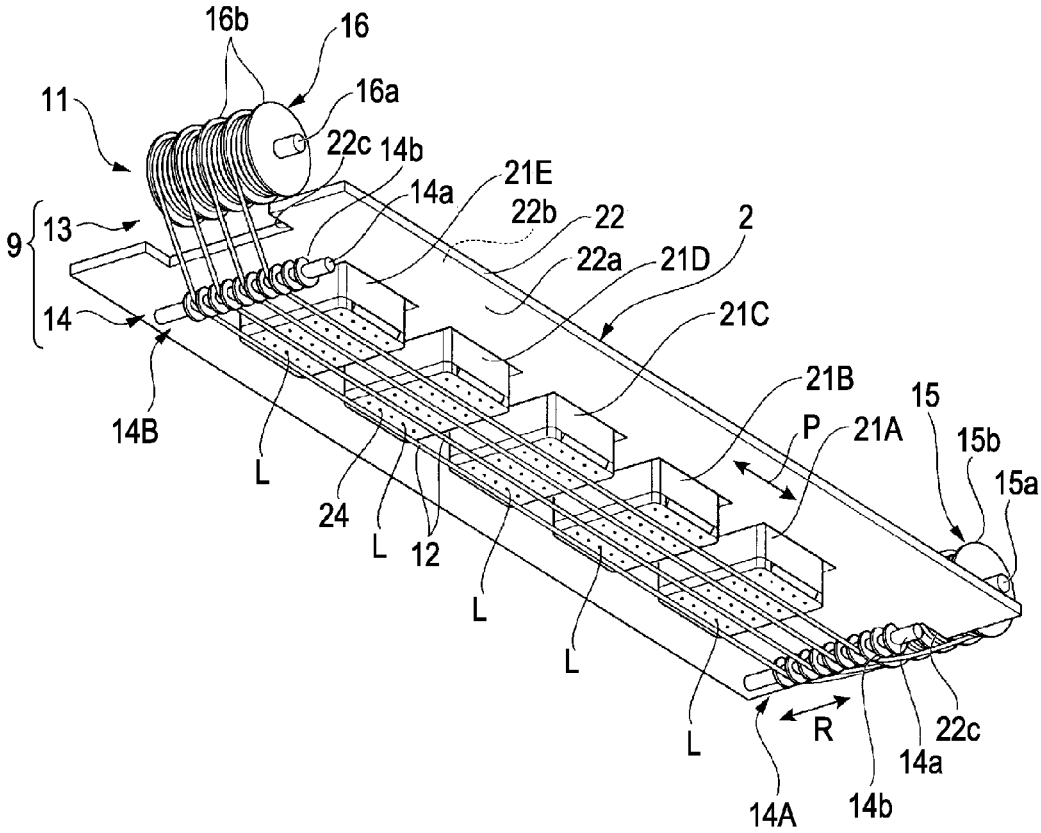
FIGS. 5A and 5B are perspective views schematically illustrating the configuration of a flushing unit according to a first embodiment.
Figure 5B:
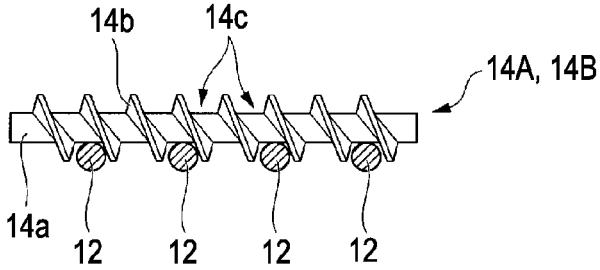

As shown in FIGS. 5A and 5B, the flushing unit 11 includes plural absorbing members 12 which absorb ink droplets (fluid) ejected during the flushing operation and a support mechanism 9 which supports the plural absorbing members 12. In this instance, FIG. 5A does not show a detection mechanism and an adjustment unit which will be described later (shown in FIG. 7), in order to show the configuration easily.

As shown in FIGS. 5A and 5B, four absorbing members 12 are provided for each head unit 2 and are formed as linear members which absorb ink droplets ejected from the nozzles 24. The absorbing members 12 are disposed so as to respectively extend along the corresponding nozzle rows (L(Y), L(M), L(C), and L(Bk)), and are located between the nozzle surfaces 23 and a sheet transporting region of the printing sheet.

In addition, the absorbing members 12 are formed of, for example, a yarn material or the like. As a material of the absorbing member 12, a chemical fiber having a surface subjected to a hydrophobic treatment is exemplified, and a material capable of efficiently absorbing and holding ink is desirable. In addition, the absorbing member 12 has a width 5 to 75 times larger than the diameter of the nozzles 24. In a general printer, a gap between the printing sheet and the nozzle surfaces 23 of the printing heads 21A to 21E is about 2 mm, and the nozzle diameter is about 0.02 mm. Accordingly, when the absorbing member 12 has a diameter of 1 mm or less, the absorbing member 12 is able to be disposed between the printing sheet and the nozzle surfaces 23 while not come into contact with each nozzle surface or the printing sheet, and when the absorbing member 12 has a diameter of 0.2 mm or more, the absorbing member 12 is able to absorb the ejected ink droplets even when taking into consideration of a certain degree of tolerance. For this reason, it is desirable that the absorbing member 12 is 10 to 50 times larger than the nozzle diameter. In addition, the absorbing member 12 will be described in detail below.

In addition, it is desirable that the absorbing member 12 has a length sufficient for the effective printing width of the head unit 2. Although it is described later in detail, the printer 1 according to this embodiment has a configuration in which the used region (after completing ink absorption) of the absorbing member 12 is sequentially wound, and the absorbing member 12 is exchanged in the case where ink is absorbed by the entire region of the absorbing member 12. For this reason, it is desirable that the length of the absorbing member 12 is about several hundreds of times longer than the effective printing width of the head unit 2 so that the exchange time of the absorbing member 12 is practically sustainable. The absorbing member 12 having the above configuration is supported by the support mechanism 9.

The support mechanism 9 includes a running mechanism 13 and a moving mechanism 14. The support mechanism 9 is substantially integrated with the head unit 2.

The moving mechanism 14 moves the absorbing member 12 between a flushing position, which absorbs the ink droplets (fluid) ejected from the nozzle 24, facing the nozzle 24 and a retraction position, which retracts from a flying path of the ink droplets (fluid) ejected from the nozzle 24, by moving the absorbing member 12 in a direction intersecting (in this embodiment, a direction R perpendicular to) the extension direction P of the nozzle row.

The running mechanism 13 runs and moves the absorbing member 12 along the extension direction of the nozzle row by delivering the absorbing member 12 from its one side and winding it at the other side. As shown in FIGS. 1 and 5A, the running mechanism 13 includes rotation bodies 15 and 16 which are provided on the rear surface 22*b* of the attachment plate 22 (on the opposite side of the nozzle surfaces 23 of the heads 21A to 21E) of the attachment plate 22. The rotation bodies 15 and 16 are placed at both sides of the head unit 2 in the direction of the nozzle row, and respectively include a delivering rotation body (delivery portion) 15 for delivery the absorbing member 12, and a winding rotation body (winding portion) 16 for winding the absorbing member 12.

In addition, the delivery rotation body 15 and the winding rotation body 16 are installed such that their rotation shafts 15*a* and 16*a* are parallel with the transport direction of the printing sheet. With the above-described configuration, the absorbing member 12 running therebetween is adapted to run and move in a direction perpendicular to the transport direction of the printing sheet, that is, from one side to the other side along the corresponding nozzle row (L(Y), L(M), L(C), and L(Bk)).

In this instance, the delivery rotation body 15 and the winding rotation body 16 are bobbin-shaped winding mechanisms which respectively include rotation shafts 15*a* and 16*a*, and plural (in this embodiment, five) partitioning plates 15*b* and 16*b* disposed in the rotation shafts 15*a* and 16*a* so as to have the same interval therebetween. Four absorbing members 12 are wound around the rotation shafts 15*a* and 16*a* so that each of the absorbing members 12 is located between the partitioning plates 15*b* and 16*b*.

In addition, the delivery rotation body 15 and the winding rotation body 16 are connected to a driving motor (not illustrated) so that winding and unwinding of the above-described plural absorbing members 12 are simultaneously carried out by each rotation. Accordingly, the running speed of the absorbing member 12 moving from the delivery rotation body 15 to the winding rotation body 16 is determined by the rotation speed of the driving motor, the tension of the absorbing member 12, or the like, but is not always constant and is slightly changed.

That is, when the absorbing member 12 is delivered from the delivery rotation body 15 and the absorbing member 12 is wound around the winding rotation body 16, its winding position and the unwinding position of the absorbing member 12 are changed on the respective rotation shafts 15 and 16 in the radial direction (thickness direction) of the respective rotation shafts and the longitudinal direction of the rotation shaft. If the unwinding position and the winding position are changed, even though the rotation speed of the driving motor is constant, the delivery speed of the absorbing member 12 delivered from the delivery rotation body 15 is slightly changed, and the winding speed of the absorbing member wound around the winding rotation body 16 is slightly changed. In addition, it is possible that the rotation speed of the driving motor is slightly changed.

The running speed of the absorbing member 12 is slightly (somewhat) changed, as described above. Since the changing level varies slightly for the above-described reason, the printing head 21 or the printing sheet does not become contaminated while in general use, as described in the related art and summary. However, if it is used for a long time, the printing head 21 or the printing sheet may be contaminated due to the changed running speed.

Therefore, the printer 1 (the fluid ejecting apparatus) according to the invention includes a detection mechanism which detects the running speed of the absorbing member 12, and an adjustment unit which adjusts the running speed of the absorbing member 12 moved by the running mechanism 13 based on the running speed of the absorbing member 12 detected by the detection mechanism. The detection mechanism and the adjustment unit will be described in detail later.

As shown in FIGS. 5A and 5B, the moving mechanism 14 includes a pair of moving members 14A and 14B each having a configuration in which a convex portion 14*b* is helically wound around a shaft portion 14*a*. The pair of moving members 14A and 14B are disposed on both sides of the head unit 2 in the nozzle row direction at the side of the front surface 22*a* of the attachment plate 22 (the nozzle surfaces 23 of the printing heads 21A to 21E). Each of the absorbing members 12 is wound around a guide groove 14*c* formed by the shaft portion 14*a* and the convex portion 14*b* of the moving members 14A and 14B.

With the above configuration, the moving mechanism 14 of the moving members 14A and 14B suspends the plural absorbing members 12 wound around the delivery rotation body 15 and the winding rotation body 16 of the running mechanism 13 between the moving members 14A and 14B. In addition, the end of the guide groove 14*c* is in a direction perpendicular to the nozzle surface 23 and this end is in a position above and at a distance from the nozzle surface 23. For this reason, it is possible to maintain the absorbing members 12 suspended on the moving members 14A and 14B so as not to come into contact with the nozzle surfaces 23 of the printing heads 21A to 21E. That is, the moving members 14A and 14B serve as a positioning member to constantly maintain the distance between the absorbing member 12 and the nozzle surface 23 of the printing heads 21A to 21E.

In addition, if the moving members 14A and 14B are not installed, and, for example, the delivery rotation body 15 and the winding rotation body 16 are directly disposed at the position of the moving member 14A, the absorbing member 12 moves between the delivery rotation body 15 and the winding rotation body 16, and thus the position of the absorbing member 12 with respect to the nozzle surface 23 is deviated. That is, as the absorbing member 12 delivered from the delivery rotation body 15 and simultaneously wound around the winding rotation body 16 moves between the delivery rotation body 15 and the winding rotation body 16, as described above, the delivering position and the winding position are changed in the longitudinal direction of the respective rotation shafts and in the diameter direction (thickness direction) of the rotation shaft on the respective rotation bodies 15 and 16. Thus, since the delivering position and the winding position are changed, the positions of the absorbing member 12 in the horizontal direction and the vertical position with respect to the nozzle surface 23 are deviated.

Further, the moving mechanism 14 includes a driving device (not illustrated) which rotationally drives the moving members 14A and 14B. In this way, for example, the absorbing member 12 moves from the retraction position to the flushing position when the moving members 14A and 14B are forwardly rotated one turn, and the absorbing member 12 moves (returns) from the flushing position to the retraction position when the moving members 14A and 14B are reversely rotated one turn.

In this instance, the moving members 14A and 14B may have a configuration in which grooves are formed around the shaft by as many as the number of the absorbing members 12, instead of the configuration in which a convex portion 14*b* is helically wound around a shaft portion 14*a*. In this instance, the driving device for driving the moving members 14A and 14B can be configured to finely move the moving members 14A and 14B along a direction R, which intersects with the nozzle row direction P, for example, by a rack and pinion, or the like.

The absorbing members 12 suspended between the moving members 14A and 14B are wound around the delivery rotation body 15 and the winding rotation body 16 through notch portions 22*c* and 22*c* formed in the attachment plate 22 so as not to come into contact with the attachment plate 22. Accordingly, it is possible to smoothly move the absorbing members 12.

With the above configuration, since each rotation speed of the delivery rotation body 15 and the winding rotation body 16 is controlled by a control device (not illustrated), the support mechanism 9 supports the plural absorbing members 12 supported on the running mechanisms 13 and the moving mechanism 14 while maintaining an appropriate tension so that the absorbing members 12 do not sag. Accordingly, it is possible to prevent the absorbing members 12 from being sagging and from coming into contact with the nozzle surfaces 23 or the printing sheet.

In addition, in the support mechanism 9, since the plural absorbing members 12 are supported by the delivery rotation body 15 and the winding rotation body 16 disposed on the side of the rear surface 22*b* of the attachment plate 22 of the head unit 2 and by the moving members 14A and 14B disposed on the side of the front surface 22*a* of the attachment plate 22, the absorbing members 12 supplied from the rotation portion 15 are adapted to be wound around the winding rotation portion 16 through the nozzle surfaces 23 (side opposite to the respective nozzle surfaces 23) of the printing heads 21A to 21E. For this reason, the absorbing members 12 are adapted to move in the extension direction of each nozzle row L of the head unit 2, that is, a direction intersecting with (perpendicular to) the transporting direction of the printing sheet in accordance with the rotation of the delivery rotation body 15 and the winding rotation body 16.

In addition, when the moving members 14A and 14B are rotated by the driving motor (not illustrated), it appears that the plural guide grooves 14*c* formed by the shaft portion 14*a* and the convex portion 14*b* move along the axial direction of the shaft portion 14*a*. Accordingly, it is possible to change the position of each of the absorbing members 12 with respect to the head unit 2 (nozzle row L). More specifically, it is possible to move the absorbing members 12 in a direction R intersecting the extension direction P of the nozzle row L of the head unit 2, that is, the transporting direction of the printing sheet, as shown in FIGS. 6A and 6B.

In this embodiment, the absorbing members 12 move between the flushing position and the retraction (printing) position. Here, when the diameter of each of the absorbing members 12 is set to 1 mm, the absorbing member 12 may move by 1 mm even when there is a tolerance in the constituent or the arrangement. When the gap of the convex portion 14*b* is set to 1 mm, since the absorbing member moves by 1 mm upon rotating the moving member one turn, it is possible to easily and highly precisely move the plural absorbing members 12. In addition, since the absorbing member moves by only 1 mm, the time for the movement of the absorbing member is short. Further, since the distance between the printing head 21 and the printing sheet is 2 mm, and the absorbing members 12 are disposed therebetween so as to have tension, it is not necessary to move the printing head 21 and the printing sheet during the movement of the absorbing member.

Figure 6A:
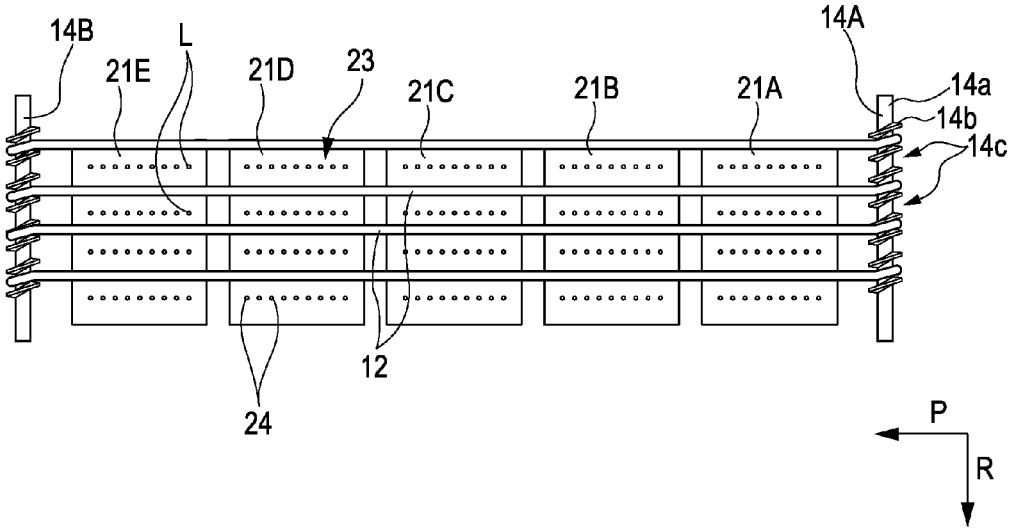
FIGS. 6A and 6B are bottom plan views illustrating a moving position of an absorbing member according to a first embodiment.
Figure 6B:
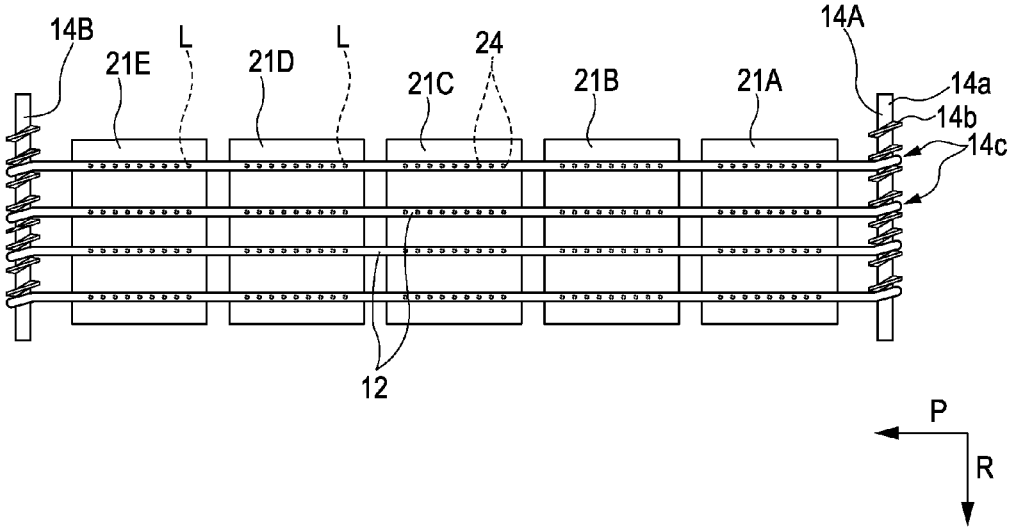

Here, as shown in FIG. 6B, the flushing position is a position where the absorbing members 12 respectively face (overlapping in a plan view) the corresponding plural nozzle rows L (the plural nozzles 24 constituting the nozzle rows L) so as to absorb the ink droplets ejected from the nozzle rows L during the flushing operation, that is, a position on the flying path of the ink. Meanwhile, as shown in FIG. 6A, the retraction position of the absorbing member 12 is a position where the absorbing members 12 do not face (not overlapping in a plan view) the nozzle rows L (the plural nozzles 24 constituting the nozzle rows L) so as not to absorb the ink droplets used for the printing operation and ejected from the nozzles 24 during the printing operation. In this instance, the expression "the absorbing members 12 face the nozzle rows L" does not mean the fact that the center of the absorbing member 12 is overlapped with the center of the nozzles 24 in a plan view, but means the fact that the nozzles 24 are positioned within the width of the absorbing member 12 in a plan view. In such a state, the absorbing member 12 can absorb the ink discharged from the nozzles 24.

As shown in FIGS. 6A and 6B, when the moving members 14A and 14B are rotated, all the absorbing members 12 move. In addition, the absorbing members 12 in the printer 1 according to this embodiment are disposed between the nozzle surfaces of the head 21 and the printing sheet in the transporting direction of the printing sheet regardless of the flushing position and the retraction position.

In addition, in FIG. 1, only one set of a head module 2, a maintenance device 10, and a flushing unit 12 is shown. However, in fact, another set of the head module 2, the maintenance device 10, and the flushing unit 12 is disposed in the transporting direction of the printing sheet. The two sets of them have the same configuration in mechanism, but are disposed to be deviated from each other in the horizontal direction (the arrangement direction of the heads 21A to 21E)

perpendicular to the transporting direction of the printing sheet. More specifically, when seen from the transporting direction of the printing sheet, the heads 21A to 21E of the head module 2 of the second set are disposed between the heads 21A to 21E included in the head module 2 of the first set.

Likewise, since two sets of the head module 2, the maintenance device 10, and the flushing unit 12 are disposed to be deviated from each other in the horizontal direction perpendicular to the transporting direction of the printing sheet, the heads 21A to 21E are disposed in a zigzag shape as a whole, and are capable of ejecting ink to the entire region of the effective printing width.

Here, in two sets of the heads 21A to 21E disposed in the zigzag shape in two sets of head modules 2, the pitch between the nozzles 24 constituting the respective nozzle rows L is formed to be constant between the adjacent heads deviated from each other in the horizontal direction perpendicular to the transporting direction of the printing sheet. That is, the adjacent heads deviated from each other are disposed in such a way that the pitch between the nozzles 24 and 24 positioned at the inner ends is identical to the pitch between the adjacent nozzles 24 and 24 in the same head. Whereas, the adjacent heads deviated from each other may be disposed in such a way that one or a plurality of nozzles 24 positioned at the inner end are arranged in one row or in plural rows along the transporting direction of the printing sheet between the heads. In the case of such an arrangement, it is preferable that the nozzles 24 and 24 arranged in one row or in plural rows between the heads are configured so as not to eject the fluid from the nozzle 24 of one head. The configuration makes the pitch between the used nozzles 24 constant.

However, in the case where the heads 21A to 21E are disposed in series in a direction perpendicular to the transporting direction of the printing sheet, only one set of the head module 2, the maintenance device 10, and the flushing unit 12 may be provided. In this case, since a sufficient gap is not formed between the heads 21A to 21E, it is difficult to provide the cap portions 61A to 61E included in the maintenance device 10 so as to respectively correspond to the heads 21A to 21E. For this reason, it is desirable to use a single cap portion capable of surrounding the nozzles 24 of all heads 21A to 21E.

Next, the detection mechanism which detects the running speed of the absorbing member 12 run and moved by the above-described running mechanism 13, and the adjustment unit which adjusts the running speed of the absorbing member 12 moved by the running mechanism 13 based on the running speed of the absorbing member 12 detected by the detection mechanism will be described.

Figure 7:
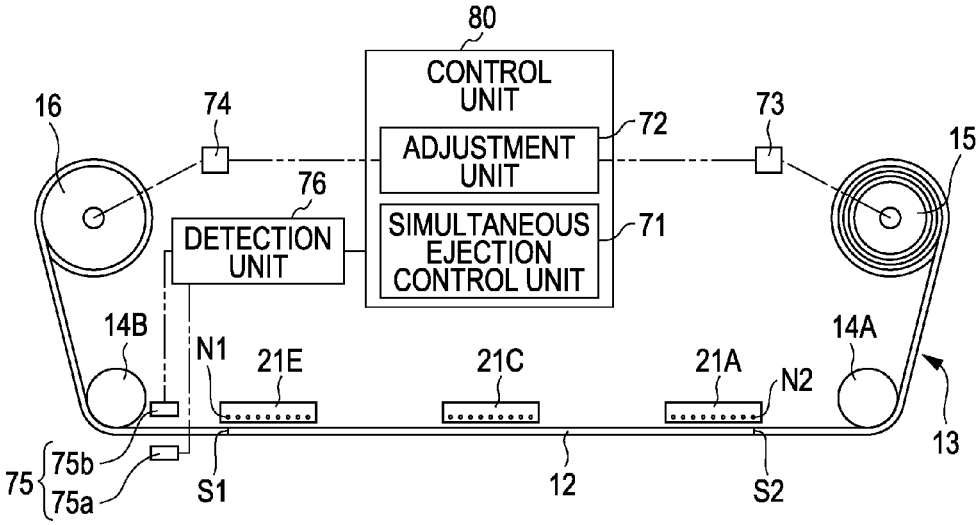
FIG. 7 is a diagram illustrating a detection mechanism and an adjustment unit according to a first embodiment.

FIG. 7 is diagram schematically illustrating the running mechanism 13, the absorbing member 12 run by the running mechanism 13, the detection mechanism and the adjustment unit in the printer 1 according to the embodiment. In this instance, in FIG. 7, a portion of the printing head 21 constituting the head unit 2 is not illustrated, and only the printing heads 21A, 21C and 21E are shown. In addition, only one row in the nozzle rows of the printing heads 21 is shown, and only one absorbing member 12 corresponding to the one row is shown.

In FIG. 7, reference numeral 80 denotes a control unit (control device), and the control unit 80 includes a simultaneous ejection control unit 71 and an adjustment unit 72. In addition, the control unit 80 controls the driving of the driving motor 73 which rotatably drives the delivery rotation body 15, and controls the driving of the driving motor 74 which rotatably drives the winding rotation body 16.

The simultaneous ejection control unit 71 controls the absorbing member 12 running between the delivery rotation body 15 and the winding rotation body 16 so as to simultaneously eject the ink droplets (fluid) from the different prescribed nozzles in the nozzle row. The expression "different prescribed nozzles" means two predetermined nozzles, and, for example, the nozzle N1 located (located at the outermost side of the winding rotation body 16) at the outermost end portion of the printing head 21E, and the nozzle N2 located (located at the outermost side of the delivery rotation body 15) at the outermost end portion of the printing head 21A in the example shown in FIG. 7 are selected (set). If two nozzles N1 and N2 simultaneously ejecting the ink droplets are set, the length (distance) between these nozzles N1 and N2 is given, and thus can be received in the detection unit which will be described later.

In addition, a position sensing unit 75 which senses a receiving position of the ink droplets ejected from the nozzles N1 and N2 of the running absorbing member 12 is installed at the winding rotation body 16 side rather than the printing head 21E, that is, between the printing head 21E and the moving member 14B. The position sensing unit 75 includes a light emitting portion 75*a* and a light receiving portion 75*b* in this embodiment, in which the light emitted from the light emitting portion 75*a* is reflected (or transmits) from the absorbing member 12, and the light receiving portion 75*b* receives the reflected light (transmitted light).

The intensity of the reflected light (transmitted light) is detected to determine the receiving positions on the absorbent member 12, that is, the position (hereinafter, referred to as a "receiving position S1") receiving the ink droplets ejected from the nozzle N1, and the position (hereinafter, referred to as a "receiving position S2") receiving the ink droplets ejected from the nozzle N2, respectively. More specifically, for example, if the ink of black color is used as the ink droplets, the intensity of the reflected light (transmitted light) at the position receiving the ink of black ink is dramatically decreased compared to the position which does not store the ink of black color. Accordingly, the position, in which the dramatic decrease in intensity is determined as the receiving positions S1 and S2 of the ink droplets.

In this instance, the configuration in which the light receiving portion 75*b* receives the reflected light or the transmitted light is appropriately set depending upon the material of the absorbing member 12, the color of the ink droplet (fluid), or the like. In addition, the light emitting from the light emitting portion 75*a* and the light receiving in the light receiving portion 75*b* is consecutively carried out from a point when the ink droplets are simultaneously ejected from the different nozzles N1 and N2 to a point when the second receiving position S2 is determined in accordance with the simultaneous ejection control unit 71. Whereas, it is preferable to stop the operation of emitting the light or receiving the light as an error, in a case where two receiving positions S1 and S2 are not determined after the prescribed time passes.

The position sensing unit 75 is connected to a detection unit 76 which detects the running speed of the absorbing member 12. The detection unit 76 detects the running speed of the absorbing member 12 based on the time when the receiving positions S1 and S2 are sensed by the position sensing unit 75. That is, the detection unit 76 recognizes and stores the time elapsed since the position sensing unit 75 starts to carry out the light emitting and receiving operation, and stores the time (time elapsed) when the receiving positions S1 and S2 are sensed by the position sensing unit 75. In this way, the detection unit 76 obtains the time from when the receiving position S1 is detected to when the receiving position S2 is detected.

In addition, the detection unit 76 is stored with the length (distance) between the nozzles N1 and N2 based on the fact of two nozzles N1 and N2 being set by the simultaneous ejection control unit 71 in advance, as described above. Accordingly, as the length (distance) between the receiving positions S1 and S2 of the ink droplets from the nozzles N1 and N2 coincides (corresponds) with the length (distance) between the nozzles N1 and N2, the length is divided by the time to obtain the running speed of the absorbing member 12.

In this embodiment, the detection mechanism is constituted by the simultaneous ejection control unit 71, the position sensing unit 75, and the detection unit 76, which are described above.

The adjustment unit 72 adjusts the running speed of the absorbing member 12 by the running mechanism 13 based on the running speed of the absorbing member 12 which is detected by the detection unit 76 (the detection mechanism). More specifically, the adjustment unit 72 already previously contains the preferable running speed range of the absorbing member 12. In addition, there is provided a determination unit which determines whether the running speed of the absorbing member 12 detected by the detection unit 76 (the detection mechanism) is within the stored preferable running speed range, is fast above the running speed range, or is slow below the running speed range.

If the running speed of the absorbing member 12 is within the preferable running speed, the adjustment unit 72 maintains the driving control of the driving motors 73 and 74 which is controlled by the control unit 80 as it is. In addition, if the running speed of the absorbing member 12 is fast above the preferable running speed range, the driving motors 73 and 74 are controlled through the control unit 80 so as to make the rotation speed of the delivery rotation body 15 and the winding rotation body 16 slightly slower by as much as the prescribed level. On the contrary, if the running speed of the absorbing member 12 is slow below the preferable running speed range, the driving motors 73 and 74 are controlled through the control unit 80 so as to make the rotation speed of the delivery rotation body 15 and the winding rotation body 16 slightly faster by as much as the prescribed level.

In this instance, the preferable running speed range and the adjustment amount of the rotation speed in the case where it exceeds the preferable running speed range have been obtained and stored by prescribed calculation or simulation.

With the configuration, for example, at the initial time when the printer 1 is used, the ink droplets are simultaneously ejected from two nozzles N1 and N2 by the simultaneous ejection control unit 71 while the absorbing member 12 runs, and thus the absorbing member 12 stores the ink droplets at each position. At that time, since it is difficult for the position sensing unit 75 to sense the number of dots (the number of droplets) of the ink droplets to be ejected if the number is less, a relatively large number, for example, several dots to dozens dots are ejected. In addition, it is preferable that the kind (color) of the ink is set as the black color, as described above.

The receiving positions S1 and S2 of the running absorbing member 12 receiving the ejected ink droplets are sensed in order by the position sensing unit 75, and the detection unit 76 detects the running speed based on the detected positions, as described above. After that, the running speed of the absorbing member 12 by the running mechanism 13 is controlled by the adjustment unit 72 based on the detected result of the running speed.

Since the running speed of the absorbing member 12 is slightly (somewhat) changed in general, as described above, the control of the running speed of the absorbing member 12 is preferably carried out only at the initial time of use, that is, on the first time of use. However, in a case where the printer is used in succession for a long time, or the like, the control can be carried out at a predetermined time interval (for example, every hour).

In the embodiment shown in FIG. 7, one absorbing member 12 is schematically illustrated, but a mechanism for detecting and adjusting the running speed of all absorbing members 12 may be installed. In addition, since the delivery rotation body 15 and the winding rotation body 16 are commonly used for all absorbing members 12 in this embodiment, a mechanism for detecting and adjusting the running speed of only one absorbing member 12 may be simply installed.

Next, the detailed configuration of the absorbing member 12 appropriately used in the printer 1 according to this embodiment will be described.

The absorbing member 12 may be formed of, for example, fiber such as SUS 304, nylon, nylon applied with a hydrophobic coating, aramid, silk, cotton, polyester, ultrahigh molecular weight polyethylene, polyarylate, or Zylon (product name), or compound fiber containing a plurality of them.

More specifically, it is possible to form the absorbing member 12 in such a manner that plural fiber bundles formed by the fiber or the compound fiber are twisted or bound.

Figure 8A:
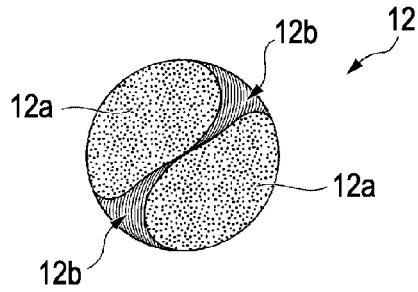
FIGS. 8A and 8B are diagrams illustrating an absorbing member provided in a printer according to a first embodiment.
Figure 8B:
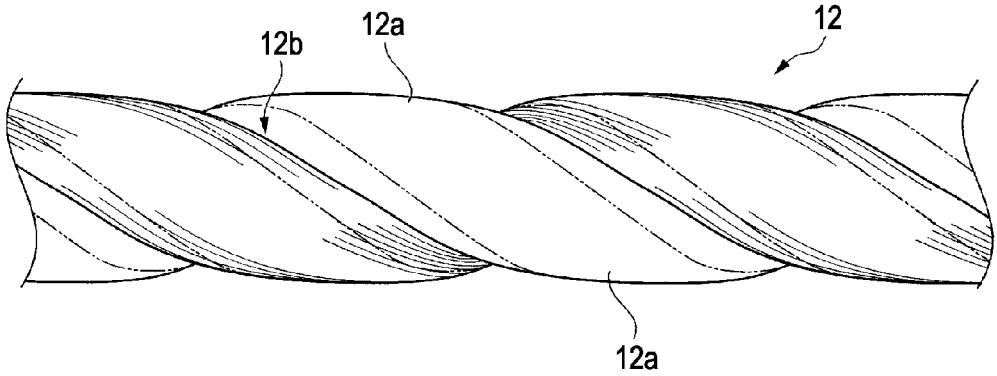

FIGS. 8A and 8B are schematic diagrams showing an example of the absorbing member 12, where FIG. 8A is a cross-sectional view and FIG. 8B is a plan view. As shown in FIGS. 8A and 8B, for example, the absorbing member 12 is formed in such a manner that two fiber bundles 12*a* formed by fiber are twisted.

In addition, as an example, a linear member obtained by twisting plural fiber bundles formed by SUS 304, a linear member obtained by twisting plural fiber bundles formed by nylon, a linear member obtained by twisting plural fiber bundles formed by nylon applied with hydrophobic coating, a linear member obtained by twisting plural fiber bundles formed by aramid, a linear member obtained by twisting plural fiber bundles formed by silk, a linear member obtained by twisting plural fiber bundles formed by cotton, a linear member obtained by twisting plural fiber bundles formed by Belima (product name), a linear member obtained by twisting plural fiber bundles formed by Soierion (product name), a linear member obtained by twisting plural fiber bundles formed by Hamilon 03T (product name), a linear member obtained by twisting plural fiber bundles formed by Dyneema hamilon DB-8 (product name), a linear member obtained by twisting plural fiber bundles formed by Vectran hamilon VB-30, a linear member obtained by twisting plural fiber bundles formed by Hamilon S-5 Core Kevlar Sleeve Polyester (product name), a linear member obtained by twisting plural fiber bundles formed by Hamilon S-212 Core Coupler Sleeve Polyester (product name), a linear member obtained by twisting plural fiber bundles formed by Hamilon SZ-10 Core Zylon Sleeve Polyester (product name), or a linear member obtained by twisting plural fiber bundles formed by Hamilon VB-3 Vectran (product name) may be appropriately used as the absorbing member 12.

Since the absorbing member 12 obtained by the fiber of nylon is formed by nylon widely used as a general leveling yarn, the absorbing member 12 is cheap.

Since the absorbing member 12 obtained by the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 obtained by the fiber of ultrahigh molecular weight polyethylene has high breaking strength and chemical resistance, and is strong against an organic solvent, acid, or alkali. Likewise, since the absorbing member 12 obtained by the fiber of ultrahigh molecular weight polyethylene has high breaking strength, it is possible to pull the absorbing member 12 in a high-tension state, and to prevent the absorbing member 12 from sagging. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the heads 21A to 21E. In addition, it is expected that the above-described advantage is obtained even in the absorbing member 12 obtained by the fiber of Zylon or aramid and the absorbing member 12 obtained by the fiber of super-high-molecular polyethylene.

The absorbing member 12 obtained by the fiber of cotton has an excellent ink absorbing property.

In this embodiment, it is preferable to use a material (state) by which the reflectance ratio or transmittance ratio are different from each other between the ejected ink and the absorbing member, so that the intensity of the reflected light or the transmitted light is significantly changed, in particular, between the portions (receiving positions S1 and S2) receiving the ink droplets and the absorbing member 12 which does not store the ink droplets. For example, it is preferable that a white-based absorbing member 12 or a translucent absorbing member 12 is used as the absorbing member 12, in the case where the black ink is used as the ink droplets to be ejected.

In the absorbing member 12, the dropped ink is accommodated and absorbed in valley portion 12*b* (refer to FIGS. 8A and 8B) formed between the fiber bundle 12*a* and the fiber due to the surface tension.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12*b*, and the rest remains in the valley portion 12*b* so as to be held therein while being dispersed in the extension direction of the absorbing member 12.

That is, the whole ink dropped onto the surface of the absorbing member 12 does not stay at the dropped position in the long-term, but is dispersed and absorbed in the vicinity of the dropped position. However, during a short time of several seconds (in the short-term), the ink is not widely dispersed from the dropped position, but almost stays at the dropped position. Accordingly, when the running speed is detected by the above-described detection mechanism, the above-described receiving positions S1 and S2 are appropriately formed on the absorbing member 12.

In fact, a material forming the absorbing member 12 provided in the printer 1 is selected appropriately in consideration of ink absorbing property, ink holding property, tensile strength, ink resistance property, formability (fluff or raveling generation), distortion, cost, or the like.

In addition, the ink absorbing amount of the absorbing member 12 is the total of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing operation in consideration of the exchange frequency of the absorbing member 12.

In this instance, the amount of ink held between the fibers of the absorbing member 12 and the amount of ink held in the valley portion 12*b* may be determined by the contact angle between the ink and the fiber, and the capillary force between the fibers depending on the surface tension of the ink. That is, when the absorbing member 12 is formed by thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as the fiber forming the fiber bundle 12*a*.

However, the ink holding force of the absorbing member 12 decreases since the capillary force decreases due to an increase in gap between the fibers. For this reason, it is necessary to set the gap between the fibers so that the ink holding force of the absorbing member 12 is equal to a degree that ink is not dropped due to the movement of the absorbing member 12.

Furthermore, the thickness of the absorbing member 12 is set so as to satisfy the above-described ink absorbing amount. More specifically, for example, the thickness of the absorbing member 12 is set to be equal to or more than 0.2 mm and equal to or less than 1.0 mm, and more desirably about 0.5 mm.

However, in order to prevent the absorbing member 12 from coming into contact with the heads 21A to 21E and the printing sheet, the thickness of the absorbing member 12 is set so that the maximum dimension of the section is equal to or less than a dimension obtained by subtracting an amount excluding the displacement amount caused by the bending of the absorbing member 12 from the distance of the sheet transporting region between the printing sheet and the heads 21A to 21E.

In this instance, the cross section of the absorbing member 12 may not be formed in a circular shape, but may be formed in a polygonal shape, since it is difficult to form the absorbing member in a perfect circular shape. A substantial circular shape is also included as a circle.

In the printer 1 having the above-described configuration, during the printing operation in which ink is ejected from the heads 21A to 21E onto the printing sheet, not all of the nozzles 24 eject ink. For this reason, the ink inside the nozzles 24 not ejecting the ink is dried, and hence viscosity increases. When the ink is thickened, it is not possible to eject a desired amount of ink. Accordingly, it is necessary to perform the flushing operation in which the ink is periodically ejected on the absorbing member 12 so as to prevent the ink from being thickened.

In addition, the absorbing member 12 included in the printer 1 according to this embodiment is located at the retraction position where the absorbing member 12 is deviated from the lower portion of the nozzle 24 upon performing the printing operation on the printing sheet, and is located at the flushing position where the absorbing member 12 is disposed right below the nozzle 24 upon performing the flushing operation. That is, since the absorbing member 12 is located right below the nozzle 24 upon performing the flushing operation, the printing operation cannot be performed, and thus the printing operation needs to be stopped. For this reason, it is desirable that the flushing operation is performed when a gap between the transported printing sheet and the printing sheet is located right below the nozzle. In a so-called line head printer such as the printer 1 according to this embodiment, since the printing operation is performed on 60 sheets of printing sheets per minute, a gap between the printing sheets is located right below the nozzle every second.

Accordingly, in the printer 1 according to this embodiment, for example, the flushing operation is performed every 5 seconds or 10 seconds.

However, in this embodiment, at the initial time of using the printer 1, as described above, the running speed of the absorbing member 12 is basically detected, and the running speed of the absorbing member 12 is adjusted based on the result.

In this instance, in the case where the printing operation is continuously performed on plural sheets of printing sheets, the time during which a gap between the printing sheets is located right below the nozzle 24 to be faced is a very short time. In the printer of the related art, the movement of the head unit or the absorbing member for the flushing operation is large. For this reason, in the known printer 1, since the flushing operation cannot be completely performed for a short time, the operation of transporting the printing sheets is temporarily stopped, and hence the time stoppage decreases the number of printing sheets per hour.

On the contrary, in the printer 1 according to this embodiment, it is possible to selectively perform the printing operation and the flushing operation just by moving the absorbing member 12 in the very narrow region right below the heads 21A to 21E. Also, it is possible to completely perform the flushing operation during a time when a gap between the printing sheets is oppositely located right below the nozzle 24, or to very shorten a time during which the printing sheet transporting operation is stopped for the flushing operation.

Next, the operation of the printer 1 according to this embodiment during the above-described flushing operation will be described with reference to the flowchart shown in FIG. 9. FIGS. 10A and 10B and FIGS. 11A and 11B are cross-sectional views of a main part illustrating the operation of the printer. In this instance, the operation of the printer 1 according to this embodiment is generally controlled by a control device (not illustrated) including the control unit 80. In addition, FIGS. 10A and 10B and FIGS. 11A and 11B do not illustrate the detection mechanism (the simultaneous ejection control unit 71, the position sensing unit 75, and the detection unit 76) and the adjustment unit 72 (the control unit 80) shown in FIG. 7 so as to simplify the explanation. In FIGS. 11A and 11B, reference numeral 8 denotes a printing sheet.

First, as the initial setting associated with the flushing operation, the running speed of the absorbing member 12 is adjusted by the detection mechanism including the simultaneous ejection control unit 71, the position sensing unit 75, and the detection unit 76, and by the adjustment unit 72, which are illustrated in FIG. 7. That is, the running speed of the absorbing member 12 is detected by the detection mechanism, and the running speed of the absorbing member 12 is adjusted by the adjustment unit 72 based on the result (S1 in FIG. 9).

If the running speed of the absorbing member 12 is initially set and the running speed is adjusted in the preferably prescribed range, the printer starts the flushing operation on the basis of a predetermined command.

Figure 9:
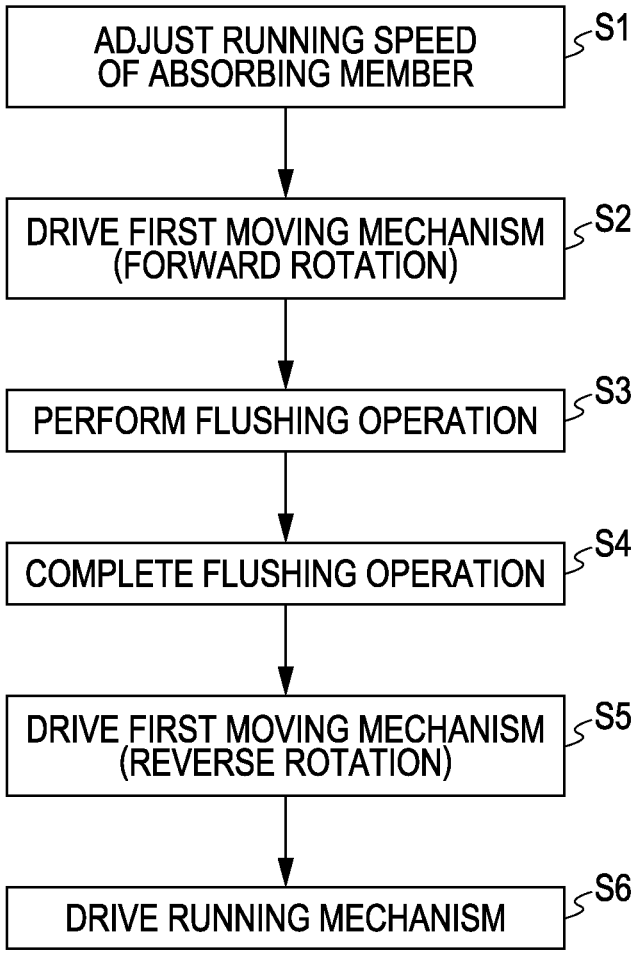
FIG. 9 is a flowchart illustrating the operation of a printer according to a first embodiment.
Figure 10:
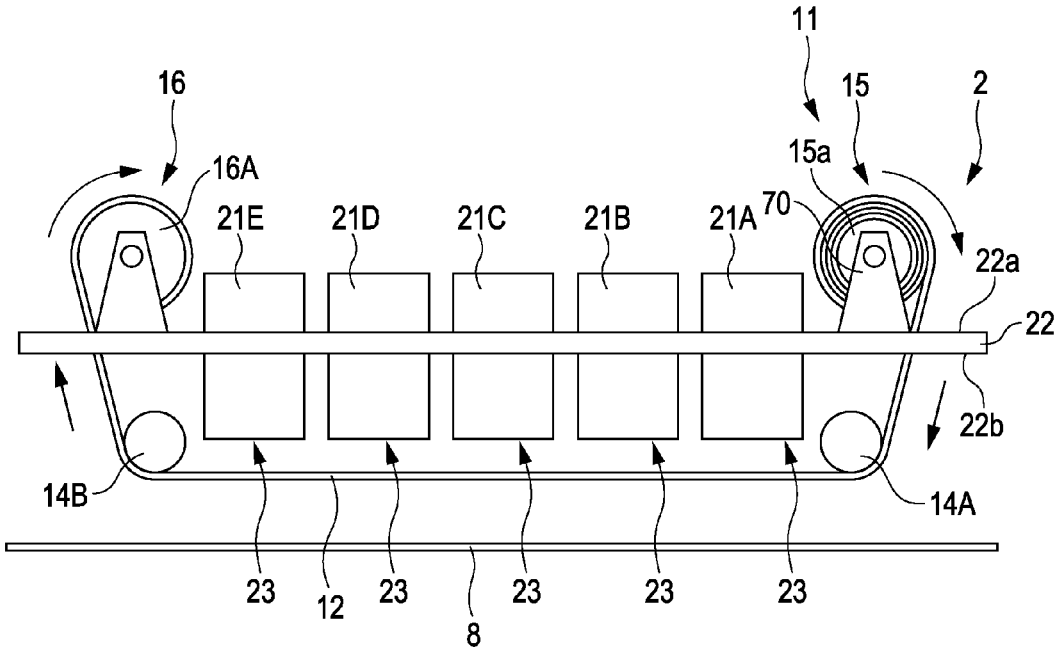
FIG. 10 is a cross-sectional view of essential parts illustrating the operation of a printer according to a first embodiment.
Figure 11A:
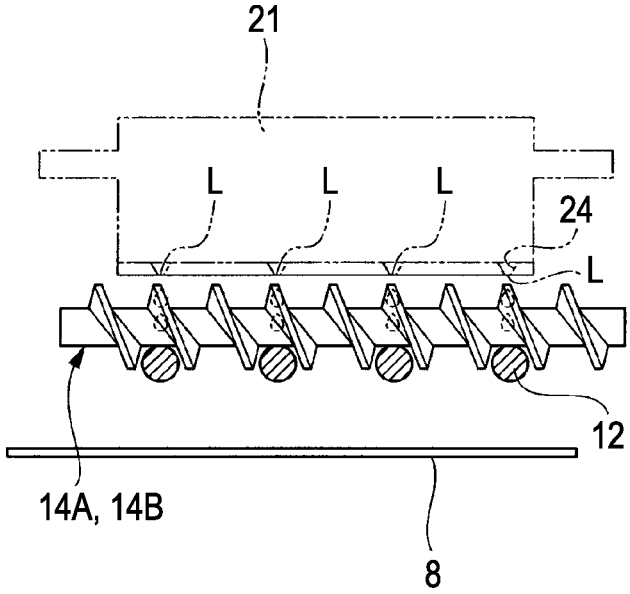
FIG. 11A is a view illustrating a flushing position of an absorbing member.
Figure 11B:
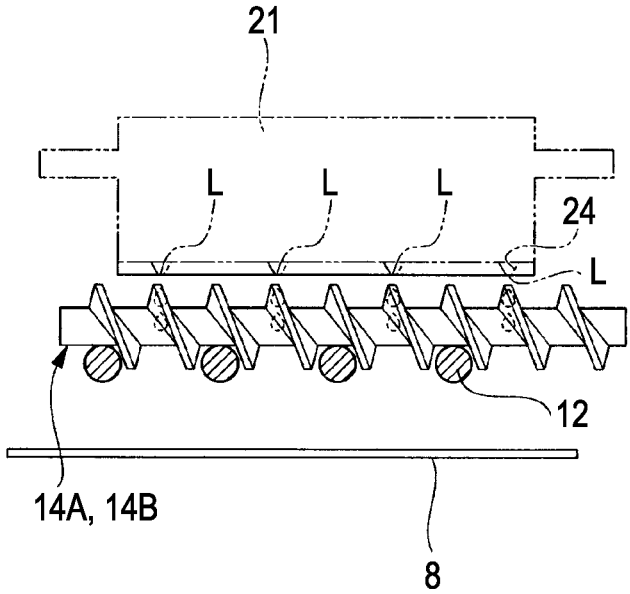
FIG. 11B is a view illustrating a retracted position of an absorbing member.

First, the control device drives the moving mechanism 14 shown in FIG. 10 (S2 in FIG. 9) so as to move the plural supported absorbing members 12 to the flushing position shown in FIG. 11A. More specifically, when the moving members 14A and 14B are rotated at a predetermined rpm (in this embodiment, by one turn), the absorbing members 12 face the nozzle rows L of the printing heads 21A to 21E respectively. At this time, as shown in FIGS. 10A and 10B, the absorbing members 12 face the nozzle rows L disposed in parallel with the arrangement direction of the printing heads 21A to 21E. Likewise, four absorbing members 12 are disposed to be overlapped on the extension line (on the flying path of the ink) of the ink ejecting direction of the nozzle rows L.

Subsequently, the control device performs the flushing operation on the head unit 2 (S3 in FIG. 9) so as to eject ink droplets (for example, about 10 droplets) from the nozzle rows L (the nozzles 24) of the printing heads 21A to 21E to the opposite absorbing members 12. The ink droplets ejected from the nozzle rows L are absorbed and received by the absorbing members 12.

If the flushing operation is completed (S4 in FIG. 9), the control device drives the moving mechanism (the first moving mechanism) 14 to move the plural absorbing members 12 to the retraction position, as shown in FIG. 11B (S5 in FIG. 9).

More specifically, as the moving members 14A and 14B are rotated by a predetermined rpm (in this embodiment, one turn), the absorbing members 12 facing the nozzle rows L are retracted from the position (position becoming the flying path) facing the nozzle row L.

After that, the control device drives the running mechanism 13 and runs and moves each of the absorbing members 12 (S6 in FIG. 9). The flushing on the absorbing members 12 is carried out between when the printing sheet is located at the position corresponding to the printing head 21, and when a next printing sheet is fed, that is, when no printing sheet is located at the position corresponding to the printing head 21. However, the movement of the absorbing member 12 by the moving mechanism 14 or the running mechanism 13 is carried out while the printing sheet is printed.

In this way, as the running mechanism 13 is driven to run and move each of the absorbing members 12, the absorbing members 12 are located at the position where the region, which does not store the ink at the next flushing, corresponds to the printing head 21, that is, on the flying path of the ink droplets. Accordingly, since the ink droplets ejected from the nozzle rows L are always received in the new region, which does not include the ink, of the absorbing member 12 by the flushing, the ink droplets are appropriately absorbed by the absorbing member 12.

At that time, after the flushing operation is carried out at plural times, most of the absorbing members 12 wound around the delivery rotation body 15 of the running mechanism 13 are wound around the winding rotation body 16, and if the winding of the absorbing members 12 by the winding rotation body 16 is completed, the absorbing members should be replaced by new ones. Since the running mechanism 13 according to this embodiment is detachably installed at the rear surface 22*b* of the attachment plate 22 via an attachment member 70, as shown in FIGS. 10A and 10B, it can be easily replaced.

With the printer 1 according to this embodiment, since the running speed of the absorbing member 12 run by the running mechanism 13 is detected by the detection mechanism including the simultaneous ejection control unit 71, the position sensing unit 75, and the detection unit 76, and the running speed of the absorbing member 12 run by the running mechanism 13 is adjusted by the adjustment unit 72 based on the detected absorbing member 12, if the running speed of the absorbing member 12 is out of the preferable prescribed running speed range, the running speed of the absorbing member 12 is adjusted by the adjustment unit 72 so as to be within the preferable prescribed running speed range, thereby stabilizing the running speed of the absorbing member 12.

Accordingly, it is possible to prevent the problem, for example, that since the running speed of the absorbing member 12 is slow, the tension is decreased lower than the set value and thus the absorbing member 12 sags downward to come in contact with the printing sheet, which causes the printing sheet to be contaminated. In addition, since the running speed of the absorbing member 12 is stabilized, the absorbing member can be accurately moved in a state where the position of the absorbing member set to the printing head 21 is maintained. Consequently, it is also possible to prevent another problem that as the absorbing member 12 is moved beyond a predetermined distance, the region not receiving the ink droplets is increased above a required level, which deteriorates the efficient use of the absorbing member 12.

In addition, as shown in FIGS. 11A and 11B, since the linear absorbing member 12 is disposed between the printing head 21 and the printing sheet 8 and the absorbing member 12 is moved to face the nozzles of the printing head 12, the ink droplets at the flushing are received and absorbed. Therefore, it is possible to carry out the flushing operation without moving the head unit 2, and thus the flushing operation can be carried out in a short time at an appropriate time.

As the fluid ejecting apparatus of the invention, a printer according to a second embodiment will now be described.

Figure 12:
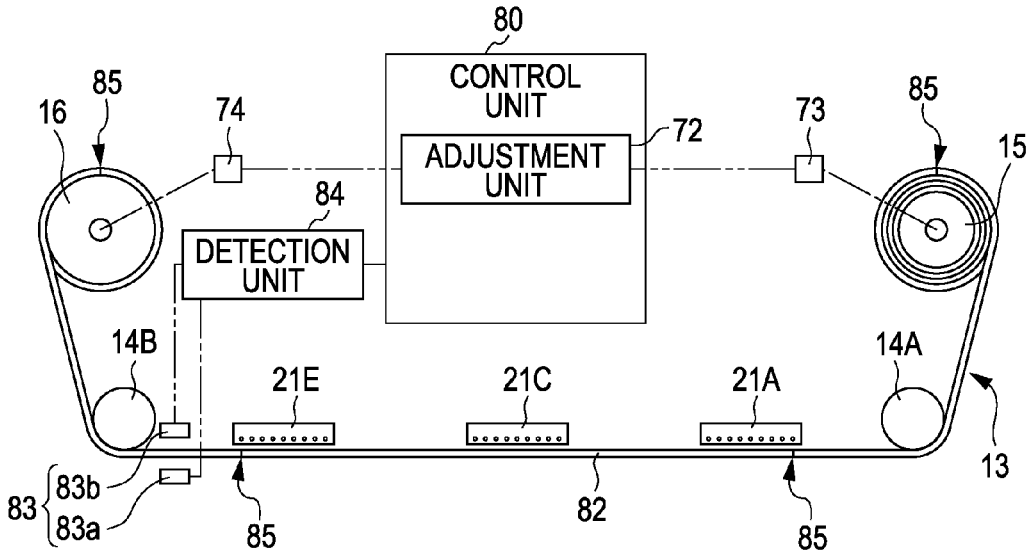
FIG. 12 is a diagram illustrating a detection mechanism and an adjustment unit according to a second embodiment.

FIG. 12 is a diagram schematically illustrating the running mechanism 13, the absorbing member run by the running mechanism 13, the detection mechanism, and the adjustment unit in the printer according to the second embodiment, and is a view corresponding to FIG. 7 illustrating the printer according to the first embodiment.

The second embodiment shown in FIG. 12 is different from the first embodiment shown in FIG. 7 in that indicators have been previously attached (marked) at a predetermined length as the absorbing member 82 in the second embodiment and that the detection mechanism according to the second embodiment includes a position sensing unit 83 and a detection unit 84, in contrast to that the detection mechanism according to the first embodiment which includes the simultaneous ejection control unit 71, the position sensing unit 75, and the detection unit 76.

That is, the printer shown in FIG. 12 uses the indicators 85 attached every predetermined length, for example, every interval (length) such as an interval (length) between the nozzle N1 and the nozzle N2 in FIG. 7, as the absorbing member 82. The indicator 85 is formed by applying, for example, the ink of black color or the like so that the portion which is not attached with the indicator 85 is easily sensed by the position sensing unit 83. In this instance, the width of the indicators 85 is not limited, but, for example, may be set to 1 to 10 times of the diameter of the nozzle of the printing head 21.

The position sensing unit 83 constituting the detection mechanism includes a light emitting portion 83*a* and a light receiving portion 83*b*, like the position sensing unit 75 shown in FIG. 7, and is located between the printing head 21E and the moving member 14B, like the position sensing unit 75 in FIG. 7. However, since the indicators 85 have been previously attached to the absorbing member 82 in this embodiment, the position sensing unit 83 can be located at an arbitrary position on which the absorbing member 82 runs, if the position does not interfere with the printing head 21 or the moving members 14A and 14B.

Further, the light emitting portion 83*a* and the light receiving portion 83*b* are configured so that the light emitted from the light emitting portion 83*a* is reflected (or transmits) from the absorbing member 82, and the light receiving portion 83*b* receives the reflected light (transmitted light), similar to the detection unit 75 shown in FIG. 7. That is, in this embodiment, the indicators 85 have been previously provided at the absorbing member 82, instead of the receiving positions S1 and S2 according to the first embodiment, and two consecutive indicators 85 are sensed by the position sensing unit 83 to detect the running speed of the absorbing member 82.

Accordingly, the detection unit 84 is similar to the detection unit 76 shown in FIG. 7, and detects the running speed of the absorbing member 82 based on the time (time elapsed) when two consecutive (adjacent) indicators 85 and 85 are sensed by the position sensing unit 83. That is, the detection unit 84 recognizes and stores the time elapsed since the position sensing unit 83 starts to carry out the light emitting and receiving operation, and stores the time (time elapsed) when the adjacent indicators 85 and 85 are sensed by the position sensing unit 83. In this way, the detection unit 84 obtains the time from when the previous indicator 85 is detected to when the next indicator 85 is detected.

In addition, the detection unit 84 is already stored with the interval (pitch) between the indicators 85 attached to the absorbing members 82, that is, the length (distance) between the adjacent indicators 85 and 85. Accordingly, as the length is divided by the time between the indicators 85 and 85 obtained by the position sensing unit 83 to obtain the running speed of the absorbing member 82.

Further, in this embodiment, there is provided the adjustment unit 72, like the first embodiment. Accordingly, in this embodiment, since the running speed of the absorbing member 82 by the running mechanism 13 is adjusted by the adjustment unit 72 based on the running speed of the absorbing member 82 detected by the detection unit 84 (the detection mechanism), thereby stabilizing the running speed of the absorbing member 82, like the first embodiment.

With the printer according to this embodiment, since the running speed of the absorbing member 82 run by the running mechanism 13 is detected by the detection mechanism including the position sensing unit 83 and the detection unit 84, and the running speed of the absorbing member 82 run by the running mechanism 13 is adjusted by the adjustment unit 72 based on the detected running speed of the absorbing member 82, if the running speed of the absorbing member 82 is out of the preferable prescribed running speed range, the running speed of the absorbing member 82 is adjusted by the adjustment unit 72 so as to be within the preferable prescribed running speed range, thereby stabilizing the running speed of the absorbing member 82.

As the fluid ejecting apparatus of the invention, a printer according to a third embodiment will now be described.

Figure 13:
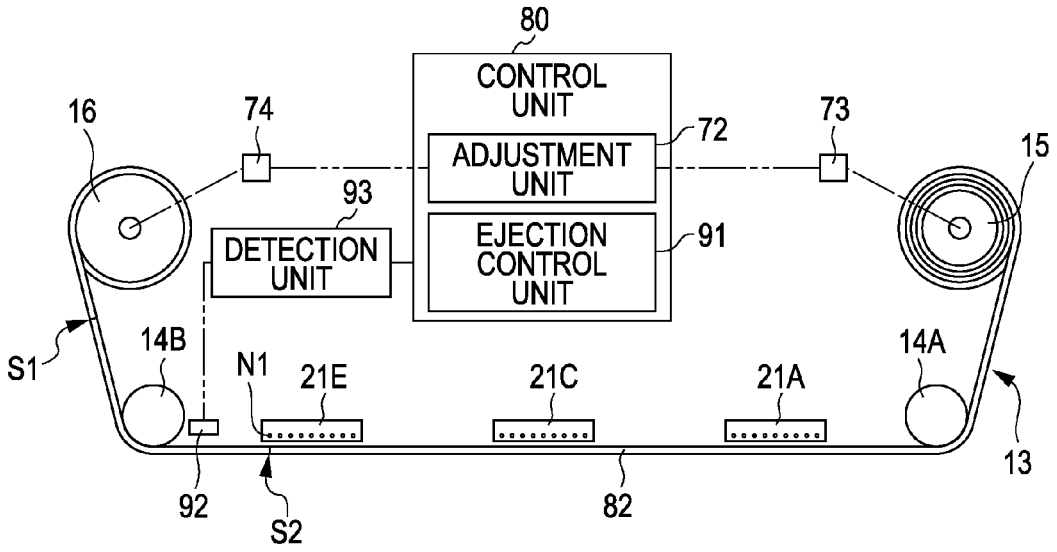
FIG. 13 is a diagram illustrating a detection mechanism and an adjustment unit according to a third embodiment.

FIG. 13 is a diagram schematically illustrating the running mechanism 13, the absorbing member 12 run by the running mechanism 13, the detection mechanism, and the adjustment unit in the printer according to the third embodiment, and is a view corresponding to FIG. 7 illustrating the printer according to the first embodiment.

The third embodiment shown in FIG. 13 is different from the first embodiment shown in FIG. 7 in that the detection mechanism according to the third embodiment includes an ejection control unit 91, a length sensing unit 92 and a detection unit 93, in contrast to that the detection mechanism according to the first embodiment which includes the simultaneous ejection control unit 71, the position sensing unit 75, and the detection unit 76.

The ejection control unit 91 controls to eject the ink droplets (fluid) at a predetermined time interval onto the absorbing members 12 running between the delivery rotation body 15 and the winding rotation body 16 from the predetermined nozzle in the nozzle rows. The expression "predetermined nozzle" means one prescribed nozzle, and, for example, in the embodiment shown in FIG. 13, the N1 (located at the outermost side of the winding rotation body 16) located at the outermost end portion of the printing head 21E is selected (set). In addition, the expression "predetermined time interval" means the time from when the predetermined number (predetermined number of dots) of ink droplets are ejected from the nozzle N1 to when the predetermine number of droplets (the predetermined number of dots) are ejected, and, for example, is set to 0.1 second to several seconds. In this way, the predetermined time interval is previously set, and then the time is stored in the detection unit 93 which will be described later.

In addition, the length sensing unit 92 which recognizes the receiving position of the running absorbing member 12, which receives the respective ink droplets ejected from the nozzle N1, and senses the length between the receiving positions is installed at the winding rotation body 16 side rather than the printing head 21E, that is, between the printing head 21E and the moving member 14B. The length sensing unit 92 includes, for example, a CCD camera (not illustrated) and an analyzing unit (not illustrated) having a computer which is connected to the CCD camera to analyze image data obtained from the CCD camera.

That is, the length sensing unit 92 recognizes the receiving position S1 receiving the ink droplets and the receiving position S2 adjacent to the receiving position S1, as the image data, by the CCD camera with lapse of the time. That is, for example, as the ink of black ink is used as the ink droplets, the contrasting density between the image data obtained from a position not receiving the ink droplets and the receiving positions S1 and S2 is remarkably differently recognized. Accordingly, the position, in which the contrasting density difference is significantly changed, is analyzed by the analyzing unit, and then is recognized as the receiving positions S1 and S2. Further, the length (distance) between the recognized receiving positions S1 and S2 is analyzed by the analyzing unit, and thus the length sensing unit 92 senses the length between the receiving positions S1 and S2 which are formed forth and back.

In addition, the detection unit 93 is already stored with the predetermined time interval when the ink droplets are ejected from the nozzle N1 by the ejection control unit 91, as described above. Accordingly, as the length (distance) between the receiving positions S1 and S2 sensed by the length sensing unit 92 is divided by the already stored time (predetermined time interval), so that the detection unit 93 detects the running speed of the absorbing member 12.

Further, in this embodiment, there is provided the adjustment unit 72, like the first embodiment. Accordingly, in this embodiment, since the running speed of the absorbing member 12 by the running mechanism 13 is adjusted by the adjustment unit 72 based on the running speed of the absorbing member 12 detected by the detection unit 93 (the detection mechanism), thereby stabilizing the running speed of the absorbing member 12, like the first embodiment.

With the printer according to this embodiment, since the running speed of the absorbing member 82 run by the running mechanism 13 is detected by the detection mechanism including the ejection control unit 91, the length sensing unit 92, and the detection unit 93, and the running speed of the absorbing member 12 run by the running mechanism 13 is adjusted by the adjustment unit 72 based on the detected running speed of the absorbing member 12, if the running speed of the absorbing member 12 is out of the preferable prescribed running speed range, the running speed of the absorbing member 12 is adjusted by the adjustment unit 72 so as to be within the preferable prescribed running speed range, thereby stabilizing the running speed of the absorbing member 12.

In this instance, one absorbing member 12 or 82 is schematically illustrated in the second embodiment and the third embodiment shown in FIGS. 12 and 13, like the first embodiment shown in FIG. 7, but, in the second embodiment and the third embodiment, there may be provided a mechanism for detecting and adjusting the running speed of all absorbing members 12 and 82.

While the preferred embodiments of the invention are described as above with reference to the accompanying drawings, it is needless to say that the invention is not limited to the preferred embodiments. It is apparent that various modifications and corrections can be made within the scope of the technical spirit according to the claims.

For example, the plurality of absorbing members 12 and 82 are configured to be simultaneously run and moved in the above-described embodiments, but may be configured to be individually run and moved.

In the above-described embodiments, the configuration is described in which the absorbing members 12 and 82 extend in parallel to the nozzle rows. However, the invention is not limited thereto, and the extension direction of the absorbing members 12 and 82 may not be perfectly parallel to the extension direction of the nozzle rows. That is, in the invention, the expression "the absorbing members extend along the extension direction of the nozzle rows" is not limited to only the case where the extension direction of the absorbing members is perfectly parallel to the extension direction of the nozzle rows, but means the case where it is within such a range that the absorbing members 12 and 82 receive the ink droplets (fluid) at flushing. In addition, at the time of retraction, the nozzle rows may be inclined. For this reason, the moving amount of the moving members 14A and 14B may be different.

Further, in the above-described embodiments, a configuration is described in which the invention is applied to the line head type printer. However, the invention is not limited thereto, but may be applied to a serial type printer.

In addition, in the above-described embodiments, a configuration is described in which the absorbing members 12 and 82 always move between the head and the printing sheet (medium). However, the invention is not limited thereto, but may adopt a configuration in which the absorbing members 12 and 82 move to a region (for example, a region on the side portions of the heads) deviated from the positions right below the heads upon retracting the absorbing members 12 and 82.

Further, in the above-described embodiments, the fluid ejecting apparatus of the invention is applied to the ink jet printer, but it may be applied to a fluid ejecting apparatus for ejecting or discharging a fluid other than ink. That is, it may be applied to various fluid ejecting apparatuses including a fluid ejecting head for ejecting a minute number of liquid droplets. In this instance, the expression "liquid droplets" means the fluid ejected from the fluid ejecting apparatus, and includes a liquid having a particle shape, a tear shape, or a linear shape. Further, here, the fluid may be a material which can be ejected from the fluid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as a pigment or metal particle is dissolved, dispersed, or mixed with a solvent in addition to a fluid. In addition, ink described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precision pipette, a printing apparatus, or a micro dispenser may be used.

In addition, a fluid ejecting apparatus for ejecting lubricant from a pinpoint to a precision machine such as a watch or a camera, a fluid ejecting apparatus for ejecting a transparent resin liquid such as a UV-curing resin onto a substrate in order to form a minute hemispherical lens used for an optical transmission element or the like, or a fluid ejecting apparatus for ejecting an etching liquid such as an acid liquid or an alkali liquid in order to perform etching on a substrate or the like may be adopted.

The entire disclosure of Japanese Patent Application No. 2010-25946, filed Feb. 8, 2010 is expressly incorporated by reference herein.

What is claimed is:

1. A fluid ejecting apparatus for ejecting fluid onto a print medium, the fluid ejecting apparatus comprising:

a fluid ejecting head having nozzle rows formed by a plurality of nozzles, in which a fluid is ejected from the nozzle rows;

a linear absorbing member which extends along the nozzle row, is installed so as to move from one side of the nozzle row to the other side, and absorbs the fluid ejected from the nozzles;

a running mechanism which runs the linear absorbing member from the one side of the nozzle row to the other side;

a detection mechanism which detects a running speed of the linear absorbing member run by the running mechanism by detecting a location of fluid ejected onto the linear absorbing member as the linear absorbing member moves from the one side to end of the other side; and an adjustment unit which adjusts the running speed of the linear absorbing member run by the running mechanism based on the running speed of the linear absorbing member detected by the detection mechanism.

2. The fluid ejecting apparatus according to claim 1, wherein the detection mechanism includes a simultaneous ejection control unit which controls the nozzle row to simultaneously eject the fluid to the running absorbing member from other predetermined nozzles, a position sensing unit which senses each receiving position of the fluid ejected from the other nozzles in the running absorbing member, and a detection unit which detects the running speed of the absorbing member based on a time when each receiving position is sensed by the position sensing unit.

3. The fluid ejecting apparatus according to claim 1, wherein the absorbing member to which is attached an indicator of a predetermined length, and the detection mechanism includes a position sensing unit which senses the indicators attached to other positions of the running absorbing member, and a detection unit which detects the running speed of the absorbing member based on a time when the indicators are respectively sensed by the position sensing unit.

4. The fluid ejecting apparatus according to claim 1, wherein the detection mechanism includes an ejection control unit which controls the nozzle row to eject the fluid to the running absorbing member at a predetermined time interval from nozzles at predetermined positions, a length sensing unit which recognizes receiving positions of the fluid ejected from the nozzles of the predetermined positions in the running absorbing member to sense the length between the receiving positions, and a detection unit which detects the running speed of the absorbing member based on the length between the receiving positions sensed by the length sensing unit.

5. The fluid ejecting apparatus according to claim 1, wherein the absorbing member extends along the nozzle row, and is configured to move relatively between a position, in which the fluid ejected from the nozzles is absorbed, and a position retracted from a flying path of the fluid ejected from the nozzles.

6. The fluid ejecting apparatus according to claim 1, wherein the running mechanism includes a rotation body which is able to wind the absorbing member thereon.

7. The fluid ejecting apparatus according to claim 1, wherein the linear absorbing member is disposed between the fluid ejecting head and the print medium receiving the fluid ejected from the nozzle rows.

* * * * *